US006215887B1

(12) United States Patent
Wei et al.

(10) Patent No.: US 6,215,887 B1
(45) Date of Patent: Apr. 10, 2001

(54) THIN TYPE SPEAKER HAVING A SECONDARY DIAPHRAGM

(76) Inventors: Oscar Wei, 7F-2, No. 7, Ching Hua St., Wen Shan District; Chin-Shui Hung, 1F, No. 253, Hu Lin St., Hsin I District, both of Taipei (TW)

( * ) Notice: Subject to any disclaimer, the term of this patent is extended or adjusted under 35 U.S.C. 154(b) by 0 days.

(21) Appl. No.: 09/175,425

(22) Filed: Oct. 20, 1998

(51) Int. Cl.[7] ..... H04R 25/00
(52) U.S. Cl. ..... 381/424; 381/423; 181/148
(58) Field of Search ..... 381/396, 398, 381/423, 424, 426, 409, 410, 186, 430, 432; 181/163, 167, 148, 164, 157, 147

(56) References Cited

U.S. PATENT DOCUMENTS 2,974,204 * 3/1961 Supitilov .
4,315,112 * 2/1982 Hofer ..... 179/115.5
4,478,309 * 10/1984 Kawamura et al. ..... 181/167
5,588,066 * 12/1996 Yang et al. ..... 381/188
5,627,904 * 5/1997 Yang et al. ..... 381/205

* cited by examiner

*Primary Examiner*—Huyen Le
*Assistant Examiner*—Phylesha Dabney
(74) *Attorney, Agent, or Firm*—Bacon & Thomas, PLLC

(57) ABSTRACT

A thin-type speaker having a secondary diaphragm. The speaker including an enclosure, a diaphragm, a yoke, a sound coil, a magnet, and a washer. The surface of a first diaphragm is covered by a secondary diaphragm. The secondary diaphragm is made of sponge, cloth, paper, cardboard or isolating fabric. A thin-type speaker constructed according to the invention can produce larger tensioning as the power increases so that the speaker has a substantially larger flat effective bandwidth and less vibration noise.

3 Claims, 6 Drawing Sheets

Measured using Sunlight 1600

Measured using Sunlight 1600

THIN TYPE SPEAKER HAVING A SECONDARY DIAPHRAGM

BACKGROUND OF THE INVENTION

1. Field of the Invention

The present invention relates to a thin type speaker, and more specifically to a speaker having a diaphragm of which the surface is covered with a secondary diaphragm. The secondary diaphragm can enhance the power capacity of the speaker and gives the speaker a larger flat effective bandwidth, with less noise. The speaker can be produced at low cost.

2. Description of the Prior Art

A conventional thin type speaker, as shown in FIGS. 1 and 2, is used in earphones, notebook computers, or miniature type radios and cassette recorders. The prior art speaker is generally composed of an enclosure 10, a mylar cone diaphragm 20, a yoke 30, a sound coil 40, a magnet 50, a washer 60 and a tab 70. The yoke 30 and the enclosure 10 can be integrated into a single piece. The diaphragm 20 is made of plastic material. Such a structure and materials were not changed in the past. After a wide application in the field, it becomes evident that the power capacity of the thin type speaker is rather small (around 0.3 watt). The vibration of the diaphragm 20 often produced noises and the fo value is high while the low frequency effect is poor. Also, the effective bandwidth is small (approximately between 1200 Hz and 10000 Hz). The dB value is around 83.4 dB at 1.26 volts (refer to FIG. 3 for details). Thus the actual sounding effect is not satisfied.

SUMMARY OF THE INVENTION

The primary object of the invention is to provide a thin type speaker having a secondary diaphragm which speaker consists of an enclosure, a mylar cone vibration diaphragm, a yoke, a sound coil, a magnet, and a washer. The vibration diaphragm is further provided with a secondary diaphragm on the surface thereof. The secondary diaphragm is made of sponge, cloth, paper, cardboard, or isolating fabric. With such a structure, the speaker can have larger tensioning at a higher power output and thus enhance the power capacity. It has been proven by tests that the power capacity of such a speaker can reach 1.5 volts. Also, the inventive speaker has larger flat effective bandwidth, which is approximately between 400 Hz and 20000 Hz, with less noise, and low costs in manufacturing.

DETAILED DESCRIPTION OF THE PREFERRED EMBODIMENTS

Figure 4:
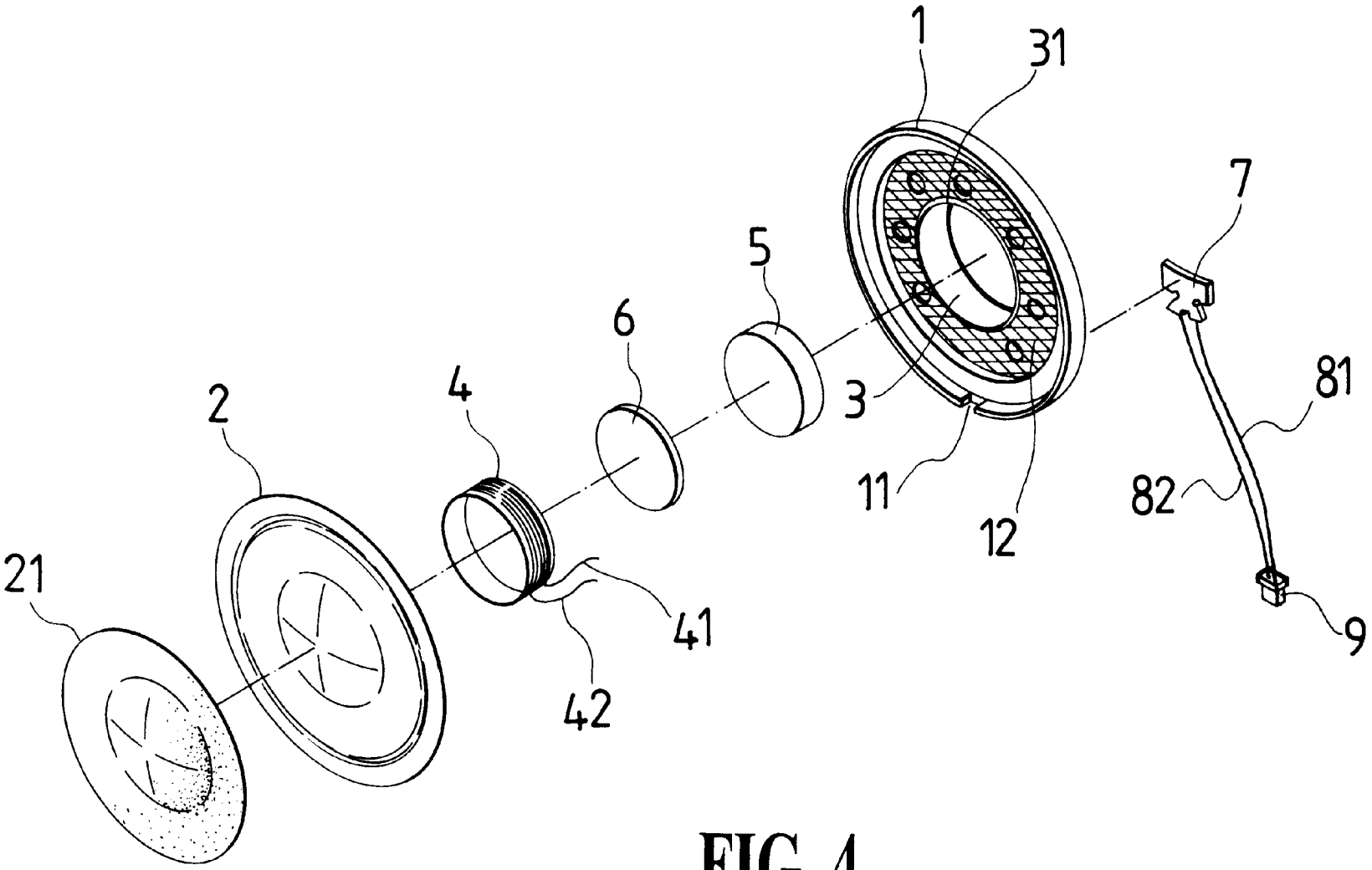
FIG. 4 is an exploded view of a thin type speaker according to the invention.
Figure 6:
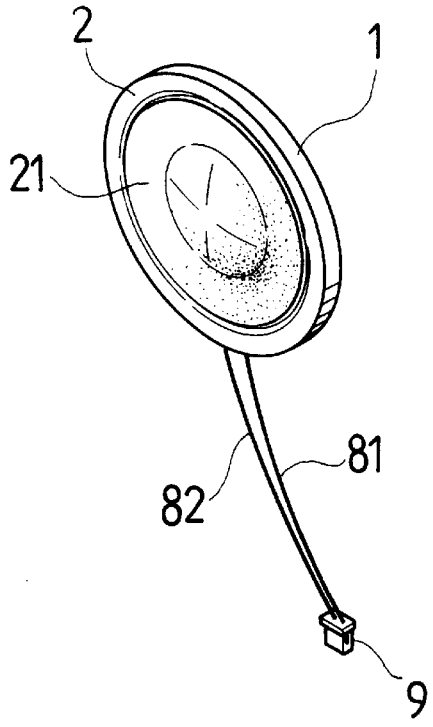
FIG. 6 is a perspective view of the speaker assembly according to the invention.
Figure 5:
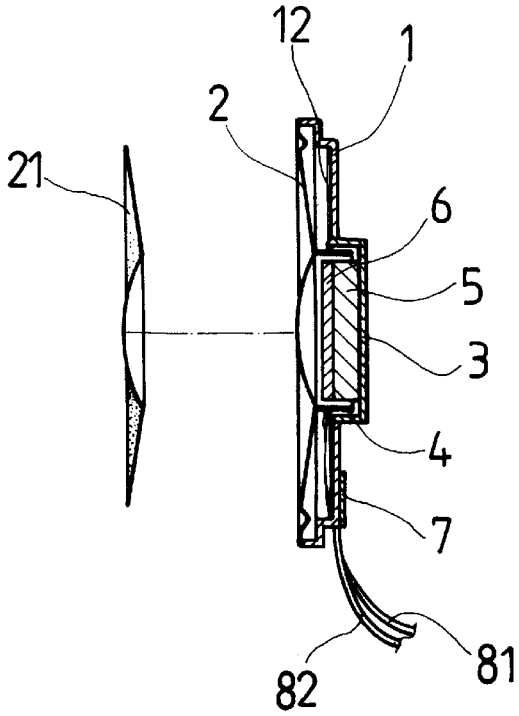
FIG. 5 is a cross sectional view of the speaker shown in FIG. 4.

As shown in FIGS. 4 to 6, the invention is a thin type speaker having a secondary diaphragm. The speaker comprises an enclosure 1, a mylar cone diaphragm 2, a yoke 3, a sound coil 4, a magnet 5, and a washer 6. The enclosure 1 is provided with a tab 7 at a chosed position. More specifically, the invention is an improvement made on the configuration of the diaphgram 2. Other parts such as the enclosure 1, the yoke 3, the sound coil 4, the magnet 5, the washer 6, and the tab 7 are similar to those included in the conventional structure and thus will not be detailed here. Also, the enclosure 1 and the yoke 3 can be integrated into a single piece, which has been known to the public.

The improvements made on the configuration of the diaphgram according to the invention primarily include a secondary diaphragm 21 attached to the surface of the mylar cone diaphragm 2. The secondary diaphragm 21 is configured to have a shape and size corresponding to the vibration surface of the diaphragm 2 so that it can be completely adhered to the diaphragm 2. The secondary diaphragm 21 is made of materials such as sponge, cloth, paper, carboard, or isolating fabric. With such an arrangement, the diaphragm 2 has a secondary diaphragm 21, which can cooperate with other conventional parts to form a thin type speaker.

The way to assemble the above components is as follows. A tab 7 is attached to a position corresponding to the notch 11 of the enclosure 1. Next, the yoke 3 having a cap configuration is placed in the central hole of the enclosure 1, with the rim 31 thereof coupled with the outer wall of the central hole to form a firm engagement. Alternatively, the yoke 3 and the enclosure 1 can be integrated into a single piece. Further, the magnet 5 and the washer 6 are placed into the yoke 3. A sound coil 4 is disposed under the diaphgram 2 in advance. After that, the sound coil 4 together with the diaphragm are placed into the enclosure 1 in such a way that the sound coil 4 embraces the magnet 5 and the washer 6, with two conductor wires 41 and 42 connected to the tab 7 on the enclosure 1 by soldering. These two conductor wires 41 and 42 of the sound coil 4 further connect to a wire connector 9 via external conductor wires 81 and 82.

The enclosure 1 described above has an inner wall surface, attached to which is a grille 12 that can prevent dusts and tiny particles from invading, which may affect the frequency response of the diaphragm 2.

Figure 1:
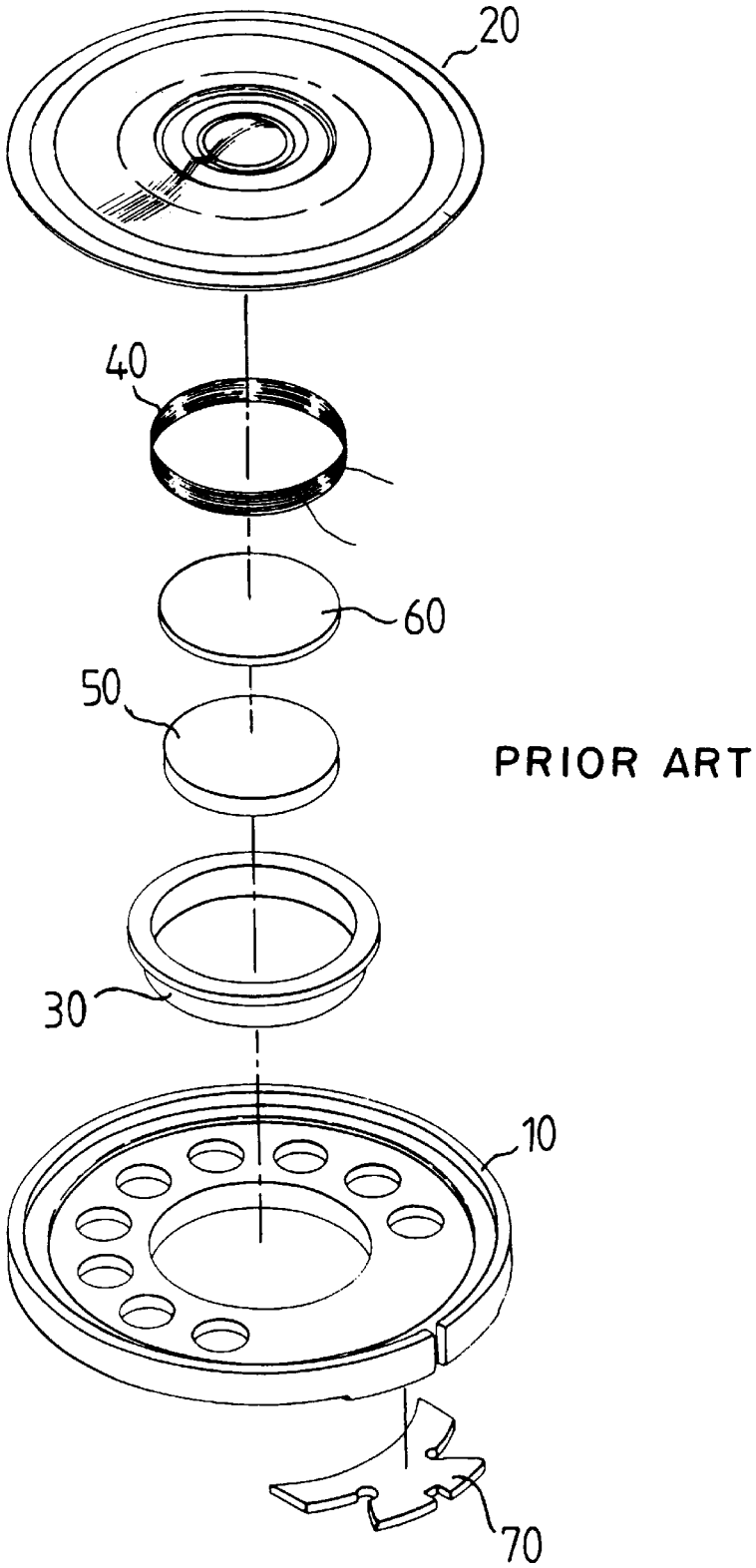
FIG. 1 is an exploded view of a conventional thin type speaker.
Figure 2:
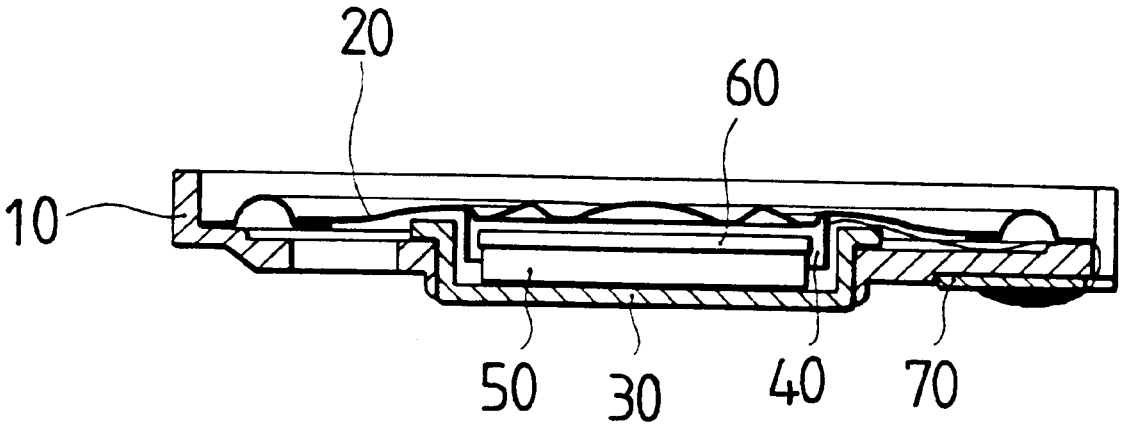
FIG. 2 PRIOR ART
FIG. 2 is a cross sectional view of the conventional speaker shown in FIG. 1.
Figure 3:
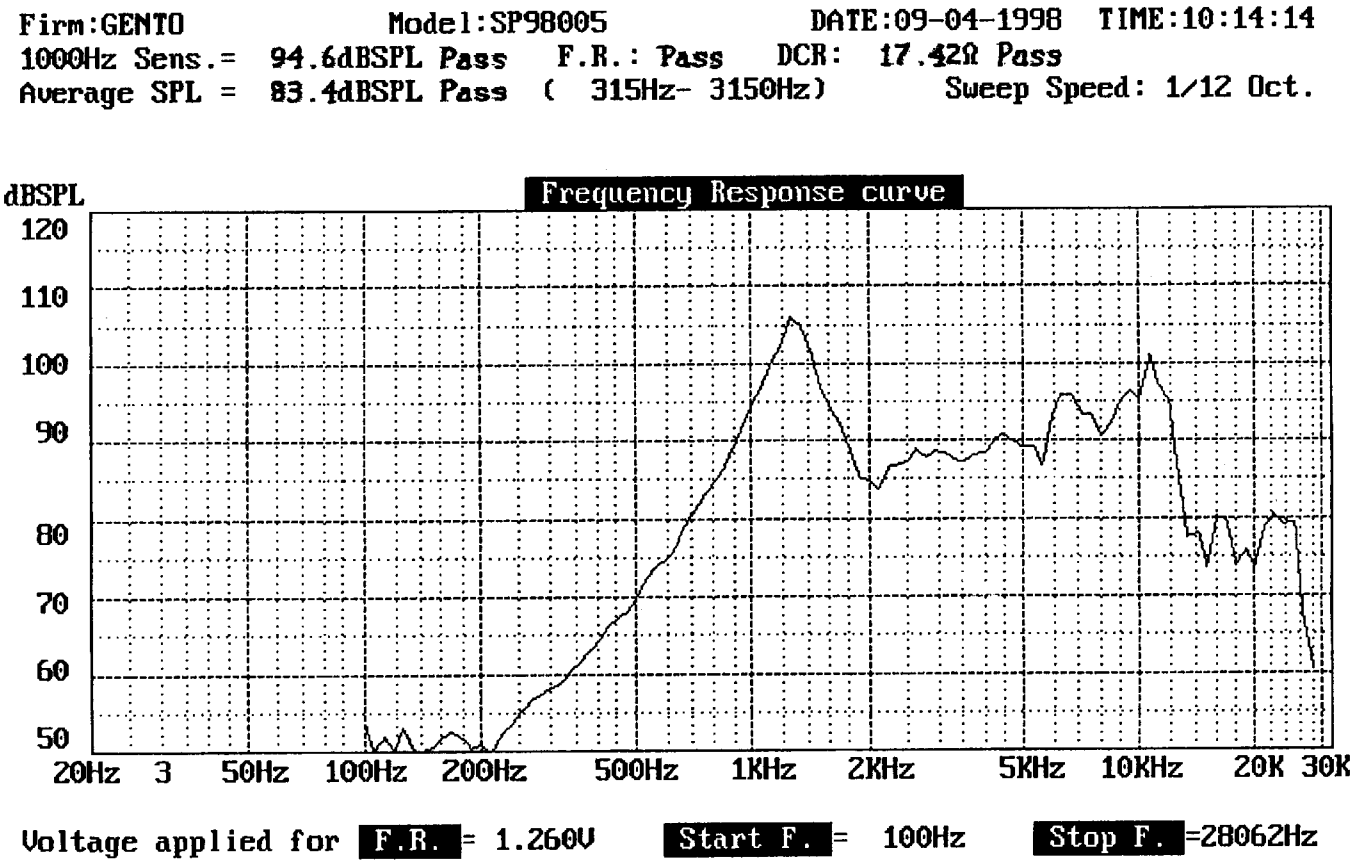
FIG. 3 is a test data diagram of the conventional thin type speaker.
Figure 7:
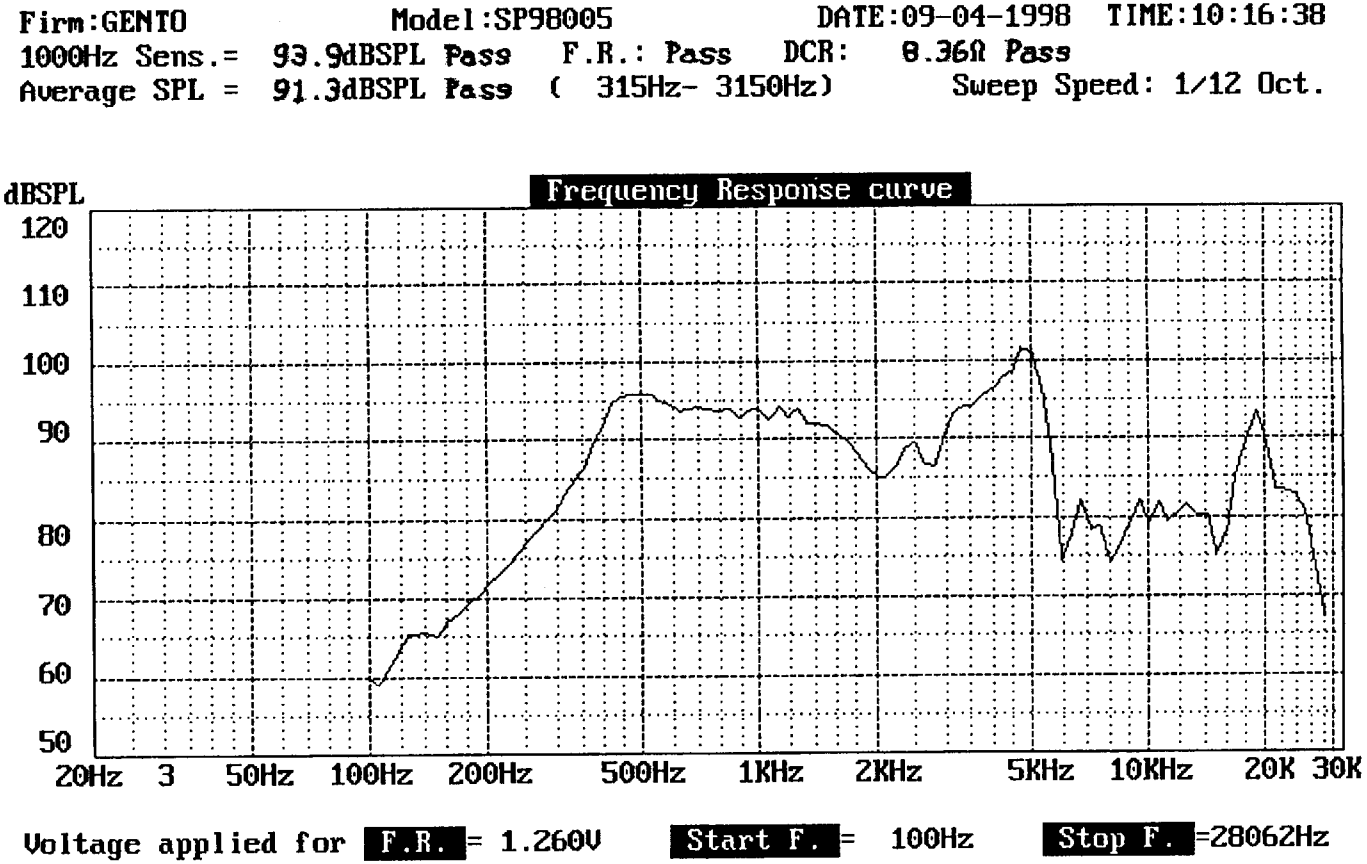
FIG. 7 is a test data diagram of the speaker according to the invention.

A diaphragm having a secondary diaphragm according to the invention and combined with other conventional parts has been completed and tested by the inventor. FIGS. 7 and 3 respectively show the test data of the inventive speaker and a conventional one. As shown in the diagrams, for a conventional speaker, the power capacity of a conventional speaker is only 0.3 watt and the fo value is high. Furthermore, the conventional speaker lacks a low frequency effect and the effective frequency bandwidth is between 1200 Hz and 10000 Hz. The dB value at the 1.26 volt is around 83.4 dB. Thus evidently the sound effect is not good. However, the test data of a speaker according to the invention indicates that the power capacity reaches 1.5 watts and the speaker has a larger and flat frequency bandwidth from 400 Hz to 20000 Hz. The improvement in the speaker performance is considerable and is innovative and useful in the industry. On the other hand, the inventive speaker is easy-to-make. The manufacturing cost of the inventive speaker is low but the effect is great.

From the above description, the improvements according to the invention is indeed a significant innovation for conventional thin type speakers. The performance of the inventive speaker is evidently superior to conventional ones.

The present invention is by no means restricted to the above-described preferred embodiments, but covers all variations that might be implemented by using equivalent functional elements or devices that would be apparent to a person skilled in the art, or modifications that fall within the spirit and scope of the appended claims.

What is claimed is:

1. A thin-type speaker comprising:

an enclosure having a central hole with an inner wall surface and an outer periphery;

a first diaphragm having an upper surface and an underside;

a yoke having a cap configuration and including a rim, the yoke received in the central hole of the enclosure with the rim coupled to the outer periphery of the central hole;

a magnet and a washer housed in the yoke;

a tab having two ends and positioned on the enclosure;

a sound coil attached to the underside of the first diaphragm and positioned in the enclosure with the first diaphragm such that the sound coil encircles the magnet and the washer;

two conductor wires each having an end attached to the sound coil and another end soldered to the tab;

a wire connector;

two external wires each having an end attached to one of the two ends of the tab and another end attached to the wire connector;

a secondary diaphragm having an outer surface, the outer surface of the secondary diaphragm positioned to face the outer surface of the first diaphragm, the upper surface of the secondary diaphragm sized and configured to correspond to the upper surface of first diaphragm such that the upper surface of the first diaphragm completely covers the upper surface of the first diaphragm; and the secondary diaphragm is made of a material selected from the group consisting of sponge, cloth, paper, cardboard and isolating fabric.

2. The thin-type speaker as claimed in claim 1, wherein the enclosure and the yoke are integrally formed into a single piece.

3. The thin-type speaker as claimed in claim 1, wherein the enclosure further comprises a protective grille positioned on the inner wall surface of the enclosure.

* * * * *